US005992368A

United States Patent [19]

Okamoto

[11] Patent Number: 5,992,368

[45] Date of Patent: Nov. 30, 1999

[54] INDUCTION SYSTEM FOR OUTBOARD MOTOR

[75] Inventor: Yutaka Okamoto, Hamamatsu, Japan

[73] Assignee: Sanshin Kogyo Kabushiki Kaisha, Hamamatsu, Japan

[21] Appl. No.: 08/975,874

[22] Filed: Nov. 20, 1997

[30] Foreign Application Priority Data

Nov. 20, 1996 [JP] Japan ..... 8-323321

[51] Int. Cl.[6] ..... B63H 21/26

[52] U.S. Cl. ..... 123/184.21

[58] Field of Search ..... 123/184.21–184.61, 123/585, 586, 588

[56] References Cited

U.S. PATENT DOCUMENTS

| | | | |
|---|---|---|---|
| 4,440,697 | 4/1984 | Sakurai | 123/184.38 |
| 4,691,671 | 9/1987 | Nishimura | 123/184.54 |
| 4,917,053 | 4/1990 | Okazaki et al. | 123/184.39 |
| 5,103,777 | 4/1992 | Daikoku | 123/184.25 |
| 5,712,422 | 1/1998 | Kato . | |
| 5,715,793 | 2/1998 | Motose . | |

*Primary Examiner*—Marguerite McMahon

*Attorney, Agent, or Firm*—Knobbe, Martens, Olson & Bear LLP

[57] ABSTRACT

An induction system for an internal combustion engine powering an outboard motor, the motor having a cowling and a water propulsion device and the engine positioned in the cowling and having an output shaft arranged to drive the water propulsion device, is disclosed. The engine has at least one combustion chamber, and the induction system is arranged to provide air to each combustion chamber. The induction system includes an intake duct having an inlet and an outlet and defining an air flow path extending from the inlet to the outlet, the inlet defining an opening through which air is drawn, the outlet arranged to deliver air passing through the duct to an intake passage leading to the combustion chamber. At least one electrical component associated with said motor is connected to the intake duct and extends into the air flow path defined therethrough, whereby the at least one component is cooled by the flow of air through the duct.

11 Claims, 6 Drawing Sheets

INDUCTION SYSTEM FOR OUTBOARD MOTOR

FIELD OF THE INVENTION

The present invention relates to an induction system for an outboard motor. More particularly, the invention is an induction system arranged to cool one or more electrical features associated with the motor.

BACKGROUND OF THE INVENTION

Outboard motors have a powerhead and a water propulsion device, such as a propeller. Typically, an internal combustion engine is positioned in a cowling defining the powerhead. The engine has an output shaft arranged to drive the water propulsion device of the motor.

The motor is movably mounted to the stern of a watercraft for propelling the craft in various directions. Generally, the motor is moveable about a vertical axis for use in steering the craft, and is tiltable about a horizontal axis for trimming the motor in an out of the body of water in which the craft is located.

If the size and weight of the outboard motor is excessive, it is difficult to turn and trim the motor, and the position of the watercraft in the water is detrimentally affected. In addition, the motor presents a surface which contributes to the aerodynamic drag of the watercraft. As such, the motor is generally made as small as possible, with the engine tightly positioned in as small of a cowling space as can be provided.

The positioning of the engine in the small space defined by the cowling is beneficial when considering the above-stated problems, but creates several other problems. A main problem is that the cowling traps the significant heat generated by the engine. This heat may damage components associated with the engine. For example, engine electrical features are often quite sensitive to high heat.

In some environments, complex liquid cooling systems are utilized to cool various engine features. In the outboard motor setting this solution is not available because this type of cooling system increases the weight and size of the engine.

It is an object of the present invention to provide an outboard motor arrangement which overcomes the above-stated problems.

SUMMARY OF THE INVENTION

The present invention is an induction system for an internal combustion engine powering an outboard motor, the motor having a cowling and a water propulsion device, and the engine positioned in the cowling and having an output shaft arranged to drive the water propulsion device.

The engine has at least one combustion chamber, and the induction system is arranged to provide air to each combustion chamber. The induction system includes an intake duct having an inlet and an outlet and defining an air flow path extending from the inlet to the outlet, the inlet defining an opening through which air is drawn, the outlet arranged to deliver air passing through the duct to an intake passage leading to the combustion chamber. At least one electrical component associated with said motor is connected to the intake duct and extends into the air flow path defined therethrough, whereby the component is cooled by intake air flowing through the duct.

Further objects, features, and advantages of the present invention over the prior art will become apparent from the detailed description of the drawings which follows, when considered with the attached figures.

BRIEF DESCRIPTION OF THE DRAWINGS

FIG. 5(*b*) is a cross-sectional view through the intake duct illustrated in FIG. 4 illustrating an outlet portion thereof with a component mounted thereto.

DETAILED DESCRIPTION OF THE PREFERRED EMBODIMENTS OF THE INVENTION

The present invention relates to an outboard motor. In general, the invention is an induction system for such a motor which is arranged to cool an accessory or component thereof, such as a control unit or circuit. The arrangement of the present invention is described in conjunction with an outboard motor since this is an application for which it has particular utility. Those of skill in the art will appreciate that this invention may have utility in a wide range of other applications.

Figure 1:
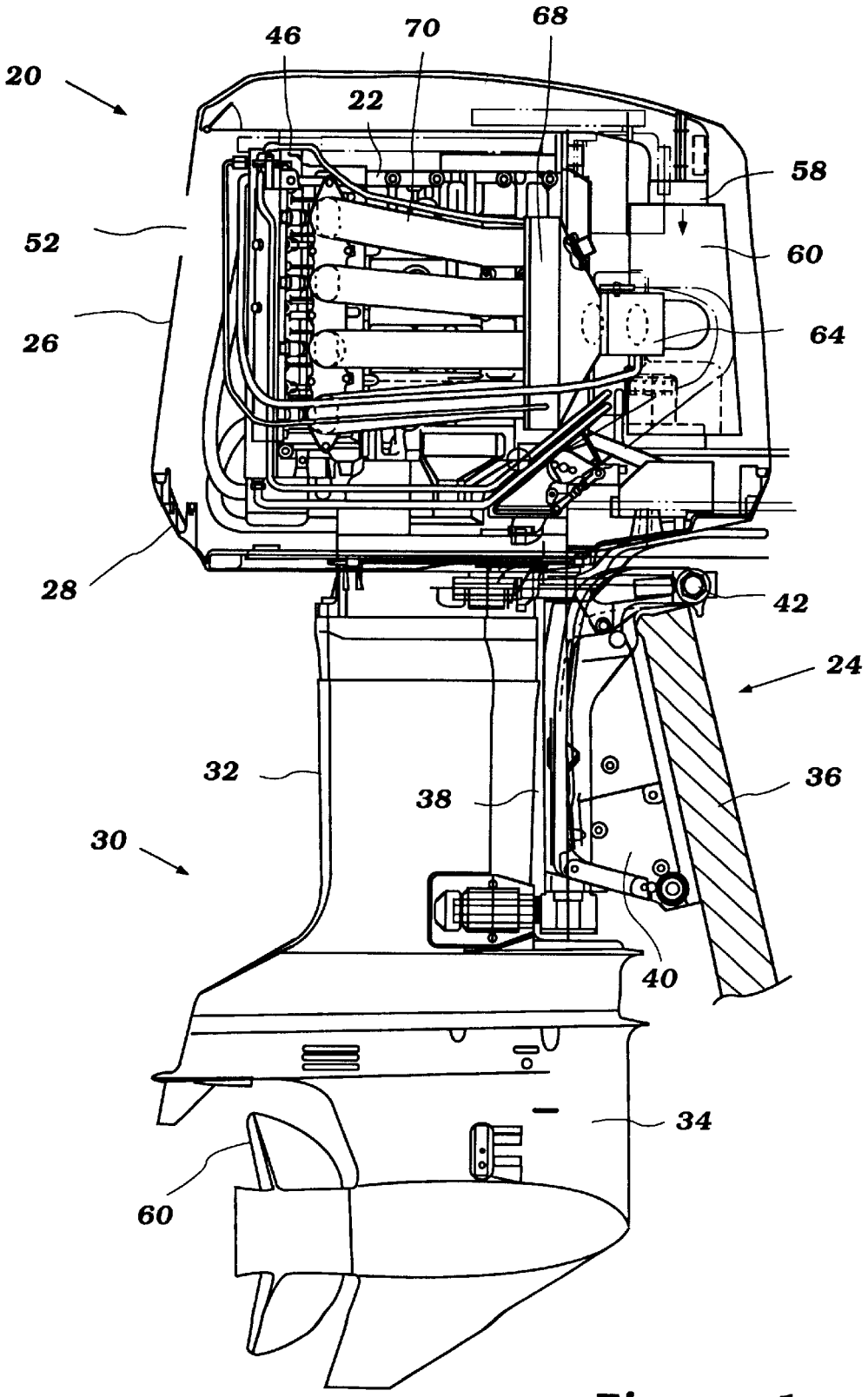
FIG. 1 is a cross-sectional side view of an outboard motor powered by an internal combustion engine and having an induction system arranged in accordance with the present invention.

FIG. 1 illustrates an outboard motor 20 powered by an internal combustion engine 22. The motor 20 is arranged to propel a watercraft 24. The outboard motor 20 has a powerhead comprised of a cowling 26 and a tray part 28 positioned therebelow. A lower unit 30 extends below the powerhead. The lower unit 30 preferably includes an upper or drive shaft housing portion 32 and a lower portion 34.

The motor 20 is movably mounted to a transom 36 of the watercraft 24. Preferably, a steering shaft (not shown) is connected to the motor 20. The steering shaft is supported for steering movement about a vertically extending axis within a swivel bracket 38. This mounting permits the motor 20 to be turned about the vertically extending axis passing through the steering shaft for steering the watercraft 24.

The swivel bracket 38 is connected to a clamping bracket 40 about a generally horizontally extending pin 42. The clamping bracket 40 is connected to the transom 36 of the watercraft 24. The mounting about the pin 42 permits the motor 20 to be trimmed or tilted up and down in a vertical plane about a horizontal axis extending through the pin 42.

The engine 22 is positioned within the cowling 26 of the motor 20. The engine 22 is preferably of the four-cylinder, inline variety, operating on a four-cycle operating principle. As may be appreciated by those skilled in the art, the engine 22 may have a greater or lesser number of cylinders, may be arranged in other than in-line fashion and may operate on other operating principles, such as a two-cycle principle.

Figure 3:
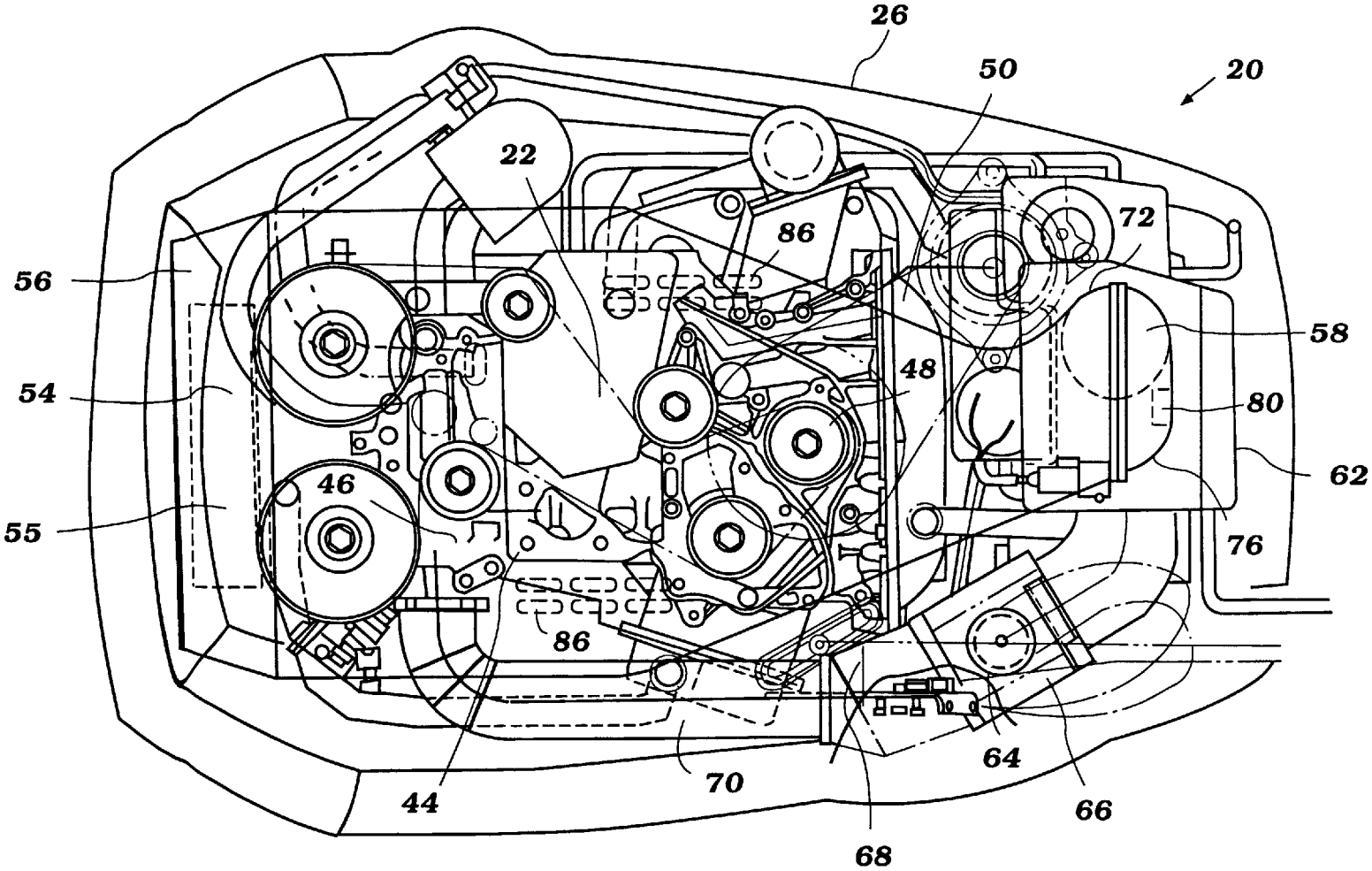
FIG. 3 is a cross-sectional top view of the outboard motor illustrated in FIG. 1 taken through the engine.

Referring to FIG. 3, the engine 22 preferably comprises a cylinder block 44 having a cylinder head 46 connected thereto and cooperating therewith to define the four cylinders. A piston (not shown) is movably mounted in each cylinder and cooperates with the cylinder head 46 and block 44 to define a combustion chamber.

Each piston is connected via a connecting rod to a generally vertically extending crankshaft 48. As illustrated, the crankshaft 48 is preferably mounted for rotation with respect to the cylinder block 44 at an end thereof generally opposite the cylinder head 46. Preferably, the crankshaft 48 is positioned in a crankcase defined by the cylinder block 44 and a crankcase cover 50. As illustrated, the engine 22 is preferably arranged so that the cylinder head 46 is positioned at a first end of the engine 22 which faces away from the watercraft 24 to which the motor 20 is connected. In this arrangement, the crankcase is at the opposing, second end of the engine 22 closest the watercraft 24.

The crankshaft 48 extends to a point below the engine 22 where it is connected to a drive shaft (not shown). The drive shaft extends through the lower unit 30 of the motor 20 and is arranged to drive a water propulsion device of the motor 20. As illustrated, the water propulsion device is a propeller 60. Preferably, the drive shaft drives a propeller shaft connected to the propeller 60, the drive shaft driving the propeller shaft through a forward-neutral-reverse transmission as known to those of skill in the art.

Figure 2:
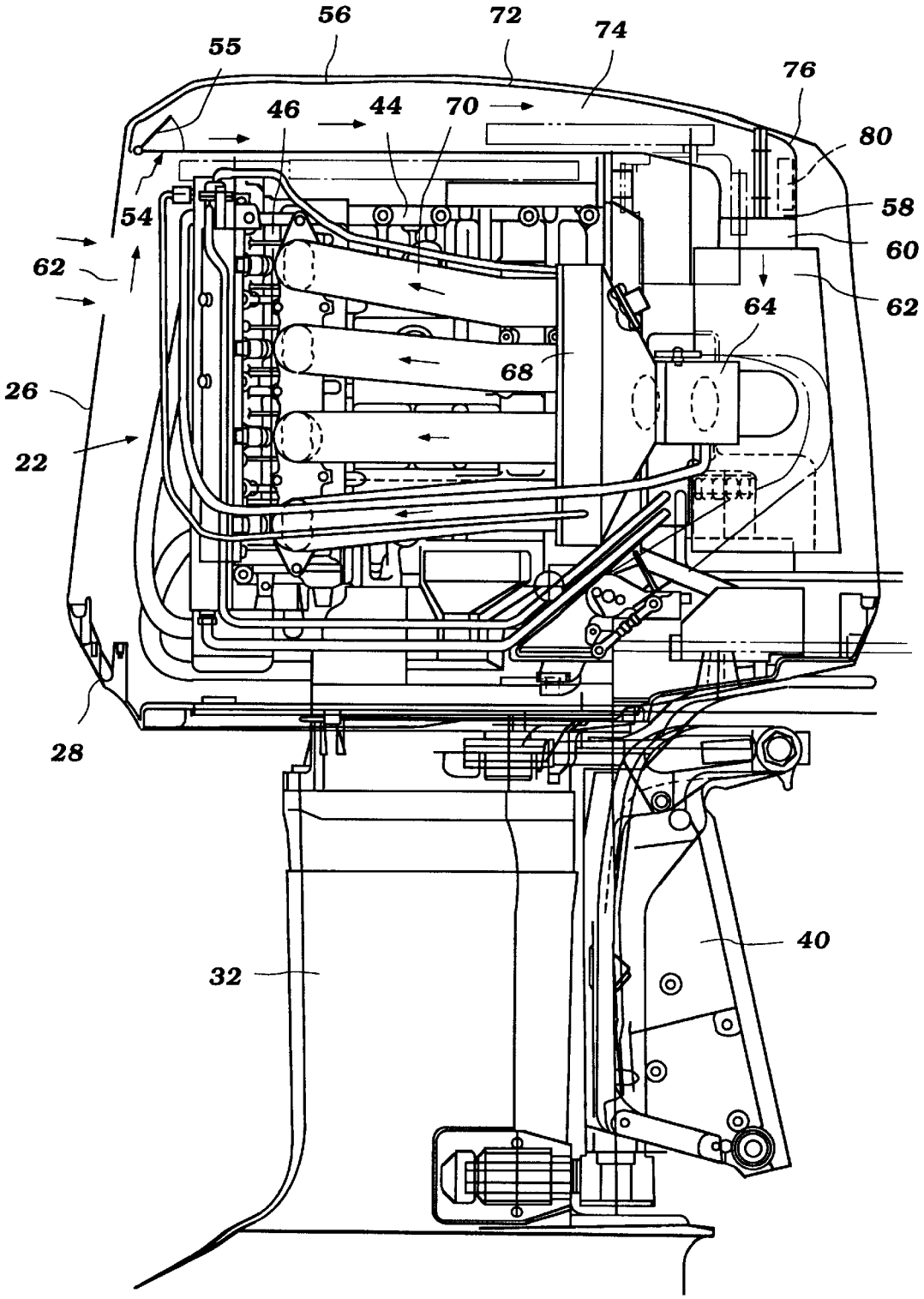
FIG. 2 is an enlarged view of a top portion of the motor illustrated in FIG. 1.

An induction system provides air to each cylinder for use in a fuel combustion process. Referring to FIGS. 1–3, the induction system includes an air vent 52 in the cowling 26 through which air is drawn. Air from within the cowling 26 is drawn through an air intake port or inlet 54 of an intake duct 56. Preferably, the flow of air through the port 54 is controlled by a flap-type valve 55. The valve 55 is preferably arranged to close under the pull of gravity when the flow of air is negligible.

The intake duct 56 is positioned above the top end of the engine 22 within the cowling 26 and extends from the cylinder head or first end of the engine 22 to the crankcase or second end of the engine 22. The particular construction of the intake duct 56 will be described in more detail below.

As best illustrated in FIG. 2, the intake duct 56 has an outlet 58 leading to an intake pipe 60. The intake pipe 60 is generally vertically extending has a passage therethrough leading from the intake duct 56 to a silencer 62. As illustrated, the silencer 62 is positioned at the end of the engine 22 opposite the cylinder head 46 and thus adjacent the crankcase cover 50.

A passage leads from the silencer 62 to a throttle body 64 having a throttle valve 66 positioned therein for controlling the flow of air through a passage through the throttle body 64. Preferably, the throttle valve 66 comprises a butterfly-type plate as know to those skilled in the art, the plate remotely movable by an operator of the watercraft 24 via a throttle control or similar mechanism.

Air which passes through the throttle body 64 past the valve 66 flows into a surge tank 68. Preferably, the throttle body 64 is positioned near one corner of the engine 22 adjacent the silencer 62, and the surge tank 68 is positioned along a side of the engine 22. An intake runner 70 extends from the surge tank 68 to an intake passage (not shown) leading through the cylinder head 46 to each cylinder 48 (i.e. in this embodiment of the invention, there are four intake runners 70, one runner 70 each corresponding to a single of the cylinders 48 of the engine 22). The runners 70 extend along a side of the engine 22 from the surge tank 68 positioned near the crankcase end to the cylinder head 46 positioned at the opposite end of the engine 22.

A fuel supply system provides fuel to the combustion chambers of the engine 22 for combustion therein and driving of the pistons. The fuel system is not described in detail herein since it forms no part of the present invention. Those of skill in the art will appreciate the wide variety of fuel systems which may be used to provide fuel for the engine.

Exhaust which is generated in the combustion chambers during the combustion of the fuel is preferably routed through an appropriate exhaust system to a point external to the motor 20. Such exhaust systems are well known to those of skill in the art.

The motor 20 preferably includes one or more accessories or components separate from the engine 22 as described above. For example, the engine 22 is preferably provided with an ignition system (not shown) for starting the combustion process of the fuel and air in each cylinder. This ignition system may include a battery which selectively powers a high-voltage ignition coil through a controller. In this system, the controller includes one or more transistors or similar switches or circuits for turning on and off the power to the ignition coil, preferably at predetermined times. When the power is selectively turned on to the ignition coil, the coil boosts the voltage (for example, from a 12 volt battery to 40,000 volts) for providing an electric charge to an ignition element associated with each combustion chamber, such as a spark plug. As may be appreciated, the function of the controller in selectively powering the ignition coil results in substantial heat generation associated with the controller. It is noted that the ignition circuit may have controllers arranged in a variety of other fashions, and include timers, thyristors or other elements.

Preferably, and in accordance with the present invention, the induction or intake system is arranged to cool one or more parts of the electrical system associated with the motor 20.

Referring to FIGS. 2–5, the intake duct 56 is preferably defined by a body 72. In the embodiment of the invention illustrated in FIGS. 1–5, the body 72 comprises a component mounting part 76 connected to a main part 77. The body 72 is elongate and defines an air path 74 therethrough from the inlet 54 to the outlet 58. The intake 54 is a passage extending through a lower part of the body 72 at a first end of the duct 56, while the outlet 58 is positioned at a second end of the duct 56.

The outlet 58 is preferably defined by a downwardly extending part of the body 72. The downwardly extending part has a generally circular passage leading from the air path 74 through the body 72 to the intake pipe 60. The downwardly extending part of the body 72 is defined by the mounting part 78 cooperating with the main part 77, which parts join along a vertically extending plane, as illustrated in FIG. 2. A gasket or similar seal may be provided for sealing the two parts 77,78 together and preventing air leaks. As illustrated, the airflow path 74 extends from the inlet 54 in a first direction across the top of the engine 22 towards the outlet 58, where the path of the air is turned in a second direction generally perpendicular to the main air flow path 74 and out the outlet 58.

At least one electrical component 80 associated with the motor 20, preferably the ignition coil controller, is connected to the duct 56 and at least partially positioned therein, whereby the intake air flowing therethrough cools the component 80. In the embodiment of the invention illustrated in FIGS. 4 and 5(*b*), the component 80 is connected to the mounting part 78 at an inside surface thereof (and thus positioned in the downwardly extending part of the body 72). When the component is a circuit board 80 or similar control unit, wiring 82 extends therefrom through a wall of the mounting part 78. This wiring 82 preferably leads to the ignition system for use in controlling the ignition coil.

The control 80 may be mounted to the mounting part 78 with a variety of means as known to those of skill in the art, such as with a bracket and screws or bolts.

Figure 4:
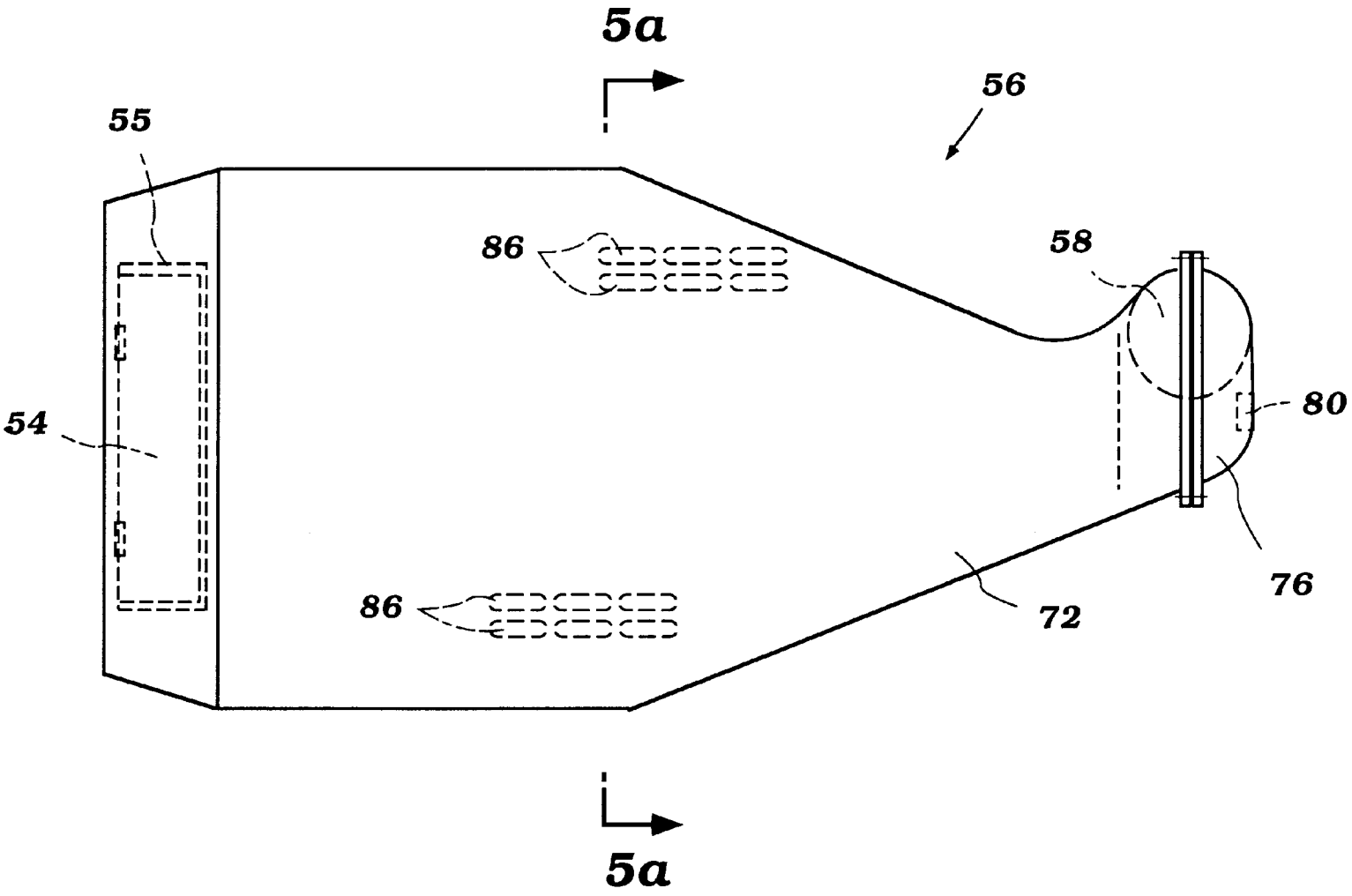
FIG. 4 is a top view of an intake duct of the induction system of the present invention.
Figure 5A:
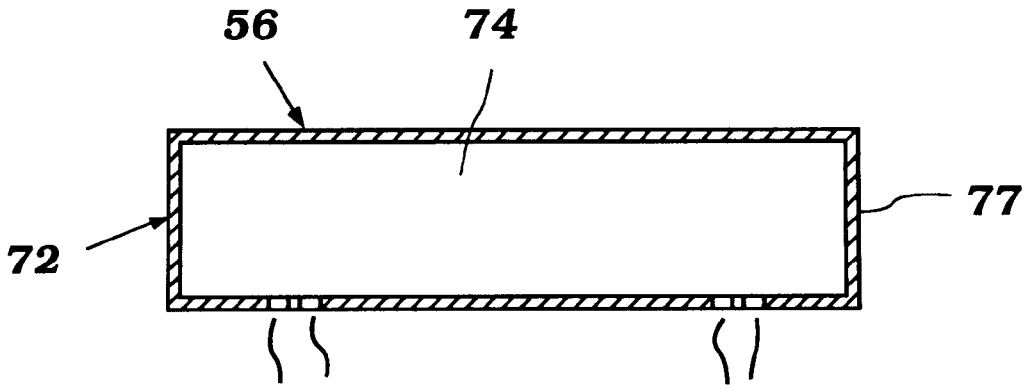
FIG. 5(*a*) is a cross-sectional view through the intake duct illustrated in FIG. 4 and taken along line 5*a*—5*a* therein.
Figure 5B:
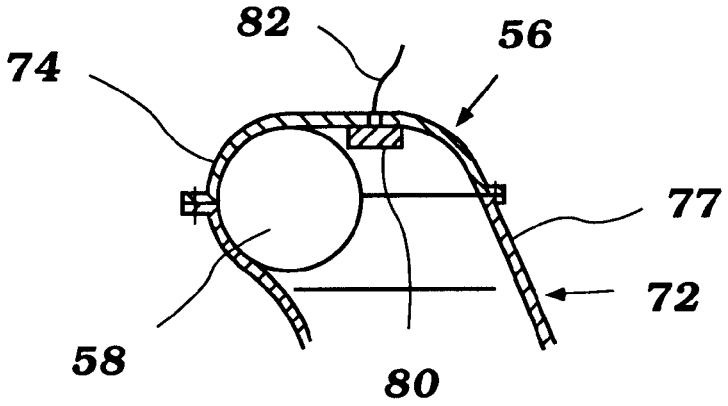

Preferably, and as best illustrated in FIG. 4, a number of air holes 86 are provided in the lower surface of the main part 77 of the body 72. As illustrated, two spaced apart pairs of rows of holes are provided through the main part 77. These holes 86 permit air to flow into the space between the duct and the engine 22. The cooler air which flows into this space serves to reduce the transfer of heat from the engine 22 to the duct 56 (and thus the component 80).

Advantageously, the induction system of the present invention is arranged to cool one or more components associated with the motor 20. Air flows through the vent 62 and intake 54 into the air passage 74 through the body 72 of the duct 56. This air is directed by the body 72 downwardly into the intake pipe 60, the air passing over the component 80 and cooling it.

As illustrated, maximum cooling is provided since the component 80 is positioned on the inside of the mounting part 78 in direct alignment with the air flow through the passage 74 at that point where the air impinges upon the mounting part 78 and is directed from its first, horizontal flow direction downwardly to its second direction to the outlet 58 and into the intake pipe 60.

An advantage of this embodiment of the invention is that the mounting part 78 may be removably connected to the main part 77. In this manner, access is provided to the component 80 even though it is positioned entirely within the body 72 of the duct 56.

Figure 6:
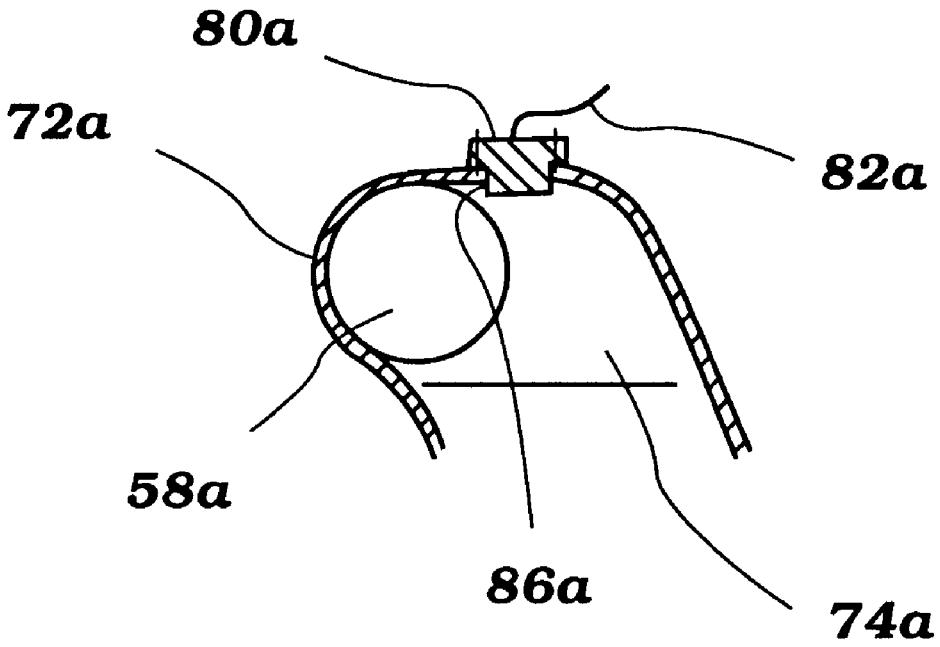
FIG. 6 is a cross-sectional view through an intake duct of an induction system in accordance with a second embodiment of the present invention.

An alternate induction system arrangement is illustrated in FIG. 6. In general, this embodiment of the invention is similar to the first, and as such, like reference numerals will be used with the same or similar parts to those described and illustrated above, except that an "a" designator has been added to all of the reference numerals of this embodiment of the invention.

In this embodiment, the body 72*a* which comprises the duct comprises a single element, such as molded thermoplastic. A bore 86*a* or similar passage is provided through the body 72*a*. The bore 86*a* is sized to receive therethrough a part of a component 80*a*. The component 80*a* is preferably removably connected to the body 72*a* of the duct.

In accordance with this embodiment of the invention, air passing through the duct again cools the component 80*a*. The component 80*a* is accessible, and readily removable, however, even through the body 72*a* is constructed as a single element. The construction of the body 72*a* as a single element has the further advantage of reducing the possibility of air leaks and simplifying manufacture and assembly of the induction system.

Of course, the foregoing description is that of preferred embodiments of the invention, and various changes and modifications may be made without departing from the spirit and scope of the invention, as defined by the appended claims.

What is claimed is:

1. An induction system for an internal combustion engine powering an outboard motor, said motor having a cowling and a water propulsion device, said engine positioned in said cowling and having an output shaft arranged to drive said water propulsion device, said engine having at least one combustion chamber, said induction system arranged to provide air to said combustion chamber, said induction system including an intake duct having an inlet and an outlet and defining an air flow path extending from said inlet to said outlet, said inlet defining an opening through which air is drawn, said outlet arranged to deliver air passing through said duct to an intake passage leading to said combustion chamber, at least one electrical component for controlling the supply of electrical power to a system associated with said motor connected to said intake duct and having at least a portion thereof extending into said air flow path, whereby said at least one electrical component is cooled by the flow of air through said duct.

2. The induction system in accordance with claim 1, wherein said intake duct is positioned at a top end of said engine between said engine and said cowling.

3. The induction system in accordance with claim 1, wherein said intake duct is defined by a wall and said at least one component extends through a passage in said wall into said air flow path.

4. The induction system in accordance with claim 1, wherein said intake duct comprises a main body and a mounting part connected to said main body, and wherein said at least one component is connected to said mounting part.

5. The induction system in accordance with claim 4, wherein said mounting part is removably connected to said main body.

6. The induction system in accordance with claim 4, wherein said mounting part cooperates with said main body to define said outlet portion of said duct.

7. The induction system in accordance with claim 1, wherein said air flow path extends in a first direction and said outlet directs air in a direction generally perpendicular to said first direction, and said at least one component is positioned adjacent said outlet where said direction of said air is changed.

8. The induction system in accordance with claim 2, wherein said duct includes a wall positioned above said engine and at least one hole is provided in said wall through which air flows.

9. The induction system in accordance with claim 1, wherein said at least one electrical component is a switching component for controlling the supply of electrical power to said system.

10. An induction system for an internal combustion engine powering an outboard motor, said motor having a cowling and a water propulsion device, said engine positioned in said cowling and having an output shaft arranged to drive said water propulsion device, said engine having at least one combustion chamber, said induction system arranged to provide air to said combustion chamber, said induction system including an intake duct having an inlet and an outlet and defining an air flow path extending from said inlet to said outlet, said inlet defining an opening through which air is drawn, said outlet arranged to deliver air passing through said duct to an intake passage leading to said combustion chamber, an ignition system component associated with said motor connected to said intake duct and extending into said air flow path, whereby said ignition system component is cooled by the flow of air through said duct.

11. The induction system in accordance with claim 10, wherein said at least one component comprises an ignition coil controller.

* * * * *